United States Patent [19]

Heinonen

[11] Patent Number: 4,712,268

[45] Date of Patent: Dec. 15, 1987

[54] DEVICE FOR CLEANING UP FLOORS

[76] Inventor: Aaro Heinonen, SF-25460, Toija, Finland

[21] Appl. No.: 854,999

[22] Filed: Apr. 22, 1986

[30] Foreign Application Priority Data

May 15, 1985 [FI] Finland ..... 851946

[51] Int. Cl.[4] ..... A47L 13/20

[52] U.S. Cl. ..... 15/231; 15/147 A

[58] Field of Search ..... 15/231, 147 A, 147 B, 15/230.17

[56] References Cited

U.S. PATENT DOCUMENTS 2,560,008 7/1951 Steward ..... 15/231

FOREIGN PATENT DOCUMENTS 324137 8/1920 Fed. Rep. of Germany ..... 15/231
45757 12/1908 Switzerland ..... 15/231
280117 4/1952 Switzerland ..... 15/231
15199 of 1914 United Kingdom ..... 15/231

*Primary Examiner*—Chris K. Moore
*Attorney, Agent, or Firm*—Cohen, Pontani & Lieberman

[57] ABSTRACT

A device for sweeping floors or the like, which device comprises a stick attached to a frame-part which has been equipped with a detachable cleaning cloth for said sweeping. In addition the frame-part includes at least two attachment spikes for attaching the cleaning cloth to the cleaning device by punching the cloth to the spikes.

4 Claims, 2 Drawing Figures

DEVICE FOR CLEANING UP FLOORS

BACKGROUND OF THE INVENTION

The present invention relates to an apparatus for cleaning up floors.

In the known floor cleaners, which comprise a stick and a planar cleaning part connected to the stick in an articulated manner, and in which detachably attached cleaning cloths are employed, the cleaning cloths are preferably attached by a clamp-structure to the grooves or the like situated on the upper surface of the cleaning part.

A drawback of the known devices is their unhygienic, dirt collecting structure, which is complicated, difficult to use and includes wearing, easily breaking components. In addition, a further drawback is that the use of disposable cloths in a bundle is difficult, almost impossible, because while detaching the topmost cloth the other cloths will also detach from the holders.

SUMMARY OF THE INVENTION

The object of the invention is to obviate the drawbacks mentioned above. In particular, the object of the invention is to bring about a floor cleaner by which the simple, hygienic and easy use of disposable cloths becomes possible.

Other features of the invention are set forth in the following description, drawings and appended claims.

The floor cleaner, according to the invention, comprises an elongated stick and a mainly planar frame-part connected advantageously in an articulated manner to the stick. The cleaning cloth to be used is wrapped partly or wholly, round the frame part and attached to it for the duration of the cleaning. The cloths are attached advantageously to the vertical sharp pointed attachment spikes situated on the opposite sides of the connection point of the stick on the centerline parallel to the side-edges of the frame-part. Protectors have been included nearby the attachment spikes. The protectors form covers for the spikes so that e.g. the spikes won't hurt the user and they won't be damaged from possible knocks.

In one advantageous adaptation of the invention a pair of spikes has been arranged on both sides of the connection point of the stick, in which case the protectors for protecting the sharp points of the spikes have been placed between the spikes of said pairs. Thus, the cleaning cloth is first attached to the spikes, situated near one side-edge of the frame-part, of said pairs and then folded round the frame-part and attached from its opposite edge to the other spikes, situated near the other side-edge of the frame-part.

In one adaptation of the invention the spikes have been placed mainly horizontally and equipped by said protectors, at which the frame-part might include protrusions or nodules for attaching the spikes or alternatively the frame-part can be made of a planar lower surface and an upper surface, to which the horizontal spikes can be fixed, rising from said lower surface.

It is also possible that the structures of the attachment spikes are situated on the side-areas of the frame-part. Similarly the spike or the spikes and the protector can be included in a coherent single integral part which is made of e.g. metal or plastic and fixed to the frame-part.

In one adaptation of the invention the spike itself has been shaped in such a manner that the sharp point has been advantageously bent downwards, in which case it doesn't constitute a danger to the user.

In one useful adaptation of the device, according to the invention, the frame-part is formed of a mainly planar part having a shape of a parallelogram. This form is especially advantageous because, although the frame-part is covered by the cloth, it will always be evident, which corner of the frame-part is sharp and can be also used for reaching cramped places and corners. For example, the right front corner is always sharp, despite the working position of the frame-part. This type of an advantageous parallelogram shape can be applied to many other cleaners or the like.

The advantages of the present invention with respect to the state of the art, is the easy, reliable and quick attachability of the cleaning cloths, as well as the simple structure of the attachment devices which don't include moving or wearing components. As the structure of the attachment mechanism is simple it won't collect dirt and it will be easy to clean, so that it is well-suited for usage in very hygienic conditions e.g. for usage in hospitals. Another advantage of the device is that disposable cleaning cloths can be used in a thick bundle at the same time, and the topmost cloth can be detached as it gets dirty while the other cloths remain in their place. Thick cloths as well as cloths of various sizes can be used in the device.

BRIEF DESCRIPTION OF THE DRAWINGS

The invention will now be described in detail with reference made to the accompanying drawing, in which.

DETAILED DESCRIPTION OF THE DRAWINGS

Figure 1:
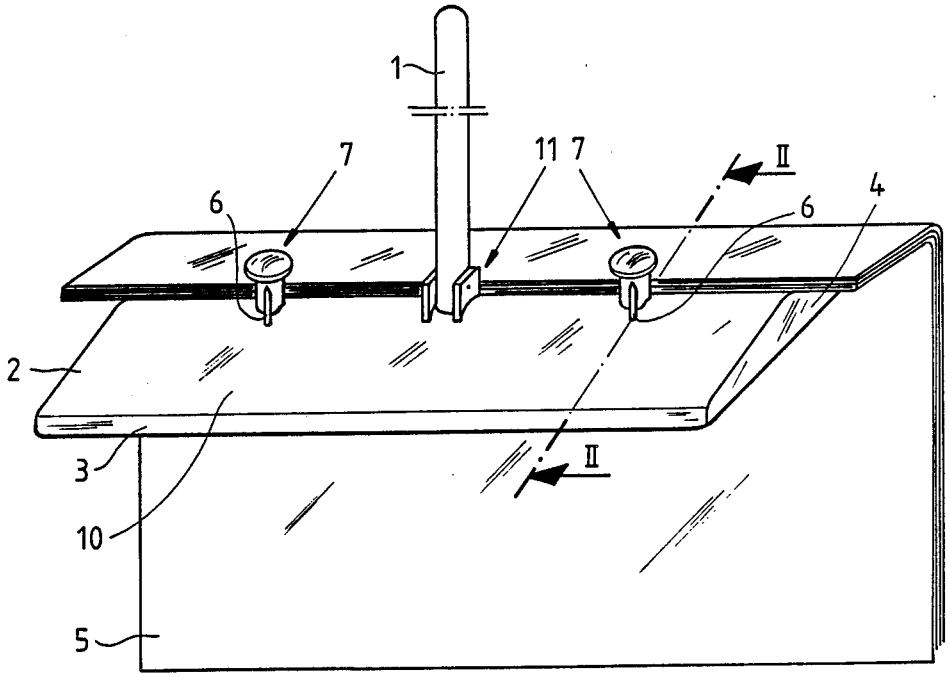
FIG. 1 shows a floor cleaner according to the invention.

The floor cleaner shown in FIG. 1 includes a stick 1 and a planar frame-part 2 connected in an articulated manner to the stick. The frame-part includes mainly straight side-edges 3 and end-edges 4 substantially shorter than the side-edges. Sharp pointed attachment spikes 6 as well as circular shield-like protectors 7 near the spikes have been fixed to the top surface 10 of the frame-part. The attachment spikes and their protectors are situated on the frame-part on the line parallel with respect to the side-edge 3 and passing through the connection point 11 of the stick.

Figure 2:
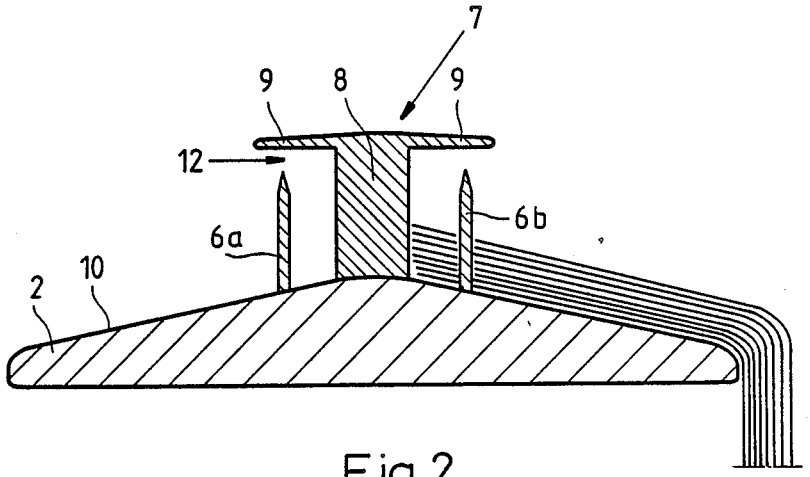
FIG. 2 shows a detail of FIG. 1.

The attachment mechanism of the device, for the cleaning cloths presented in FIG. 1, has been presented in FIG. 2. The mechanism includes attachment spikes *6a, 6b* fixed on the top surface 10 as well as a protector 7 fixed on the top surface between the spikes. The protector 7 is formed of a circular shank 8 and a wider plate-like spike protector 9 situated on the top of the shank at a distance apart from the spikes above them so that a gap 12 remains between the protector and the point of the spike.

The use of the device takes place in the following manner. A bundle of disposable cleaning cloths is attached from one straight edge of the bundle to the spikes 6 by pressing the edge of the bundle through the gap 12 so that the spikes are punched through the whole bundle at a distance apart from the edge of the bundle. In this manner the bundle is attached on both sides of the connection point 11, at which point the device is ready for usage. The cloth bundle can be folded round the frame-part 2 and attached also from its opposite edge to the other spikes of the spike pairs. Advantageously, however, the cloth is attached only from its other edge, because the usable cleaning surface will, thus, be substantially larger and the cloth remains securely in its attachments without detaching during the cleanup. As the cloth becomes dirty it is easy to detach by gripping its upper corner and lifting it off from the attachments, while the cloths below remain in their place and the next cloth is ready for usage.

The protectors 7 according to the invention can also be of other shape, as long as they protect the points of the spikes and prevent the user from being hurt by the spikes.

The above described device according to the invention for cleaning up floors has been explained by refering to one useful application of the invention. This doesn't limit the invention in any way, as the various modifications of the invention can vary within the scope of the the invention defined by the claims.

What is claimed is:

1. An apparatus for sweeping floors comprising:

a frame-part connectable to a stick;

at least two spikes mounted on the frame-part for detachably receiving a cleaning cloth by punching the cloth to the spikes; and a protector for each spike for protecting the user from the spike and the spike from outside knocks, the protector comprising a shank attached to the frame-part and a spike protector connected to the shank near the point of the spike.

2. An apparatus for sweeping floors comprising:

a frame-part connectable to a stick;

a pair of spikes mounted on the frame-part on both sides of the stick for detachably receiving a cleaning cloth by punching the cloth to the spikes; and a protector for the pairs of spikes for protecting the user from the spikes and the spikes from outside knocks, the protector comprising a shank attached to the frame-part between each pair of spikes and a spike protector connected to the shank, the spike protector extending over the points of the spikes.

3. An apparatus according to claim 1 wherein the frame-part has the shape of a parallelogram formed of parallel side-edges and parallel end-edges.

4. An apparatus according to claim 2 wherein the frame-part has the shape of a parallelogram formed of parallel side-edges and parallel end-edges.

* * * * *